United States Patent [19]

Johnson

[11] 3,946,441

[45] Mar. 30, 1976

[54] SAFETY HELMET

[75] Inventor: John R. Johnson, Arcadia, Calif.

[73] Assignee: Land Tool Company, Wichita, Kans.

[22] Filed: Mar. 19, 1973

[21] Appl. No.: 342,600

[52] U.S. Cl. ..... 2/3 R
[51] Int. Cl. ..... A42B 3/02
[58] Field of Search ..... 2/3 R, 6

[56] References Cited

UNITED STATES PATENTS

| | | | |
|---|---|---|---|
| 2,619,639 | 12/1952 | Hendler | 2/6 |
| 3,023,134 | 2/1962 | Cresswell et al. | 2/6 |
| 3,116,490 | 1/1964 | Zbikowski | 2/3 R |
| 3,242,500 | 3/1966 | Derr | 2/3 R |
| 3,245,087 | 4/1966 | Marchello | 2/3 R |
| 3,320,619 | 5/1967 | Lastnik et al. | 2/6 |
| 3,418,657 | 12/1968 | Lastnik et al. | 2/6 |
| 3,437,631 | 4/1969 | Cleveland | 2/3 R |
| 3,500,475 | 3/1970 | Otsuka | 2/3 R |

FOREIGN PATENTS OR APPLICATIONS

| | | | |
|---|---|---|---|
| 945,819 | 1/1964 | United Kingdom | 2/6 |

*Primary Examiner*—Werner H. Schroeder

[57] ABSTRACT

A safety helmet for vehicular use constructed of two superimposed shells to take advantage of the physical properties of each of the materials for the shells and cancel out any disadvantages. The shells preferably are constructed of different plastic materials such as a fiberglass reinforced plastic and a tough plastic such as a polycarbonate.

12 Claims, 6 Drawing Figures

SAFETY HELMET

DISCLOSURE OF THE INVENTION

This invention relates to an improved safety helmet particularly adapted for use with vehicles such as motorcycles and the like.

Present day safety helmets for vehicular use are generally constructed of a single shell shaped to be worn on the head and having an energy absorbing or shock absorbing liner secured to the shell. The helmet shells presently being manufactured for vehicular use are constructed of either a reinforced plastic such as fiberglass or a molded tough plastic such as polycarbonate plastics. It has been found that from a practical standpoint, a helmet shell constructed with either of these materials is not optimum for use as a vehicular helmet. A fiberglass reinforced plastic shell is generally more expensive to manufacture than an injection molded plastic shell such as one constructed of a polycarbonate material. Polycarbonate plastics are the toughest plastics presently known for manufacturing helmets. Fiberglass resins are thermosetting and by virtue of inherent cross linking of the resins are generally stable and inert. The glass fibers form a mesh that is difficult to separate. As a result, the advantage of a fiberglass shell is that even though the resin matrix may shatter under impact the glass fibers hold the shell together in one piece. Fiberglass shells, however, are relatively brittle and tend to fracture under even minor impacts. After a substantial impact, the thermosetting resin in the fiberglass fractures. Despite the advantages of the fiberglass shells, the polycarbonate helmet shells are usually lighter in weight than one constructed of fiberglass leading to more comfort for the wearer. Polycarbonate shells are very tough and are not generally affected by repeated impacts either in use or in testing. A polycarbonate shell will stand up to repeated impacts without change. Polycarbonate resins, however, tend to be unstable and subject to stresses. The polycarbonate shell will not hold together upon a catastrophic impact that fractures the shell. Despite the aforementioned advantages the above types of prior art helmets and other presently known prior art types all have been found to be extremely inefficient in meeting the needs relative to the practical and realistic production of helmets.

Shock liners that are presently used for such safety helmets are basically of two types — resilient and nonresilient. Most nonresilient liners are constructed of an expanded polystyrene (EPS) and are of a relatively low density. The resilient liners are of a higher density and vary with respect to their dynamic crushability. The selection of a resilient or nonresilient shock or energy absorbing liner is a design compromise based on the advantages and disadvantages of the various types of material. At the present time, the expanded polystyrene (EPS) is the least expensive material commercially available and in use and is lightweight and has a high stiffness to weight ratio. Expanded polystyrene is relatively unaffected by temperature variations relative to impact forces and is not affected by rate of strain. The expanded polystyrene generally suffers from lack of recovery and as a result may be completely crushed and permanently deformed by a single impact that greatly reduces its ability to attenuate an impact blow, absorb energy or reduce energy transfer in the event the subsequent blows to the liner are in the same area as the first impact.

The resilient energy absorbing liners are generally constructed of materials selected from the urethane elastomers, rubbers and some foamed thermo-plastics such as foamed polyethylene. The resilient shock liners tend to recover after receiving impact forces thus making them more suitable for helmet use. Some urethane materials, for example, are extremely sensitive to rate of strain. This characteristic can be used to advantage since the strain sensitivity is in the form of viscose damping that is usually associated with a hysteresis property which is also beneficial as far as the total energy that may be dynamically absorbed. The resilient materials, however, are fairly more expensive, heavier and more sensitive to temperature variations than the nonresilient materials.

The present invention provides an improved safety helmet that advantageously combines the advantages of shells constructed of prior art materials such as fiberglass and polycarbonate material through the utilization of the combination of such materials so that the physical characteristics of these materials complement one another under impact and provide an improvement in efficiency not heretofore known. The novel helmet of the present invention is constructed of two shells of different materials and arranged in a preselected relationship so as to virtually eliminate the problems of present day helmets by combining the advantageous features of materials such as fiberglass and polycarbonate while cancelling out the negative features of both of these materials. The safety helmet is constructed with an inner shell made of a polycarbonate plastic material to take advantage of the toughness of this material so as to provide a safety helmet that is virtually break proof by providing a primary shell that suffers no permanent damage under impact. The improved safety helmet includes the advantages of a fiberglass shell by arranging such a shell on the outside of the polycarbonate shell so as to serve as a relatively inert environmental barrier for the primary or polycarbonate shell with the two coacting to distribute impact forces to which the helmet is subjected. The fiberglass outer shell also provides a structure that will contain the polycarbonate shell in the event this primary shell were to suffer a catastrophic failure during a severe impact.

Specifically, from a structural standpoint the present invention comprises a molded plastic primary shell shaped to be worn on the head of a user and having a relatively thin reinforced plastic material secured to the outside of the plastic primary shell in a preselected fashion so as to function as a relatively inert environmental barrier for the molded plastic inner shell. An energy absorbing liner which may be of either resilient or nonresilient material, or both, is secured to the inside of the molded plastic shell. The two shells are arranged together so as to function to distribute any impact forces impinging on the outer reinforced plastic shell. In one specific embodiment of the invention, the primary plastic shell may be a polycarbonate material while the reinforced plastic is a fiberglass resin, the polycarbonate shell having a thickness on the order of three to four times that of the fiberglass reinforced shell. A thin layer of abrasion and chemical resistant material may also be applied to the outer surface of the outer fiberglass shell.

These and other features of the present invention may be more fully appreciated when considered in the light of the following specification and drawings, in which.

Figure 1:
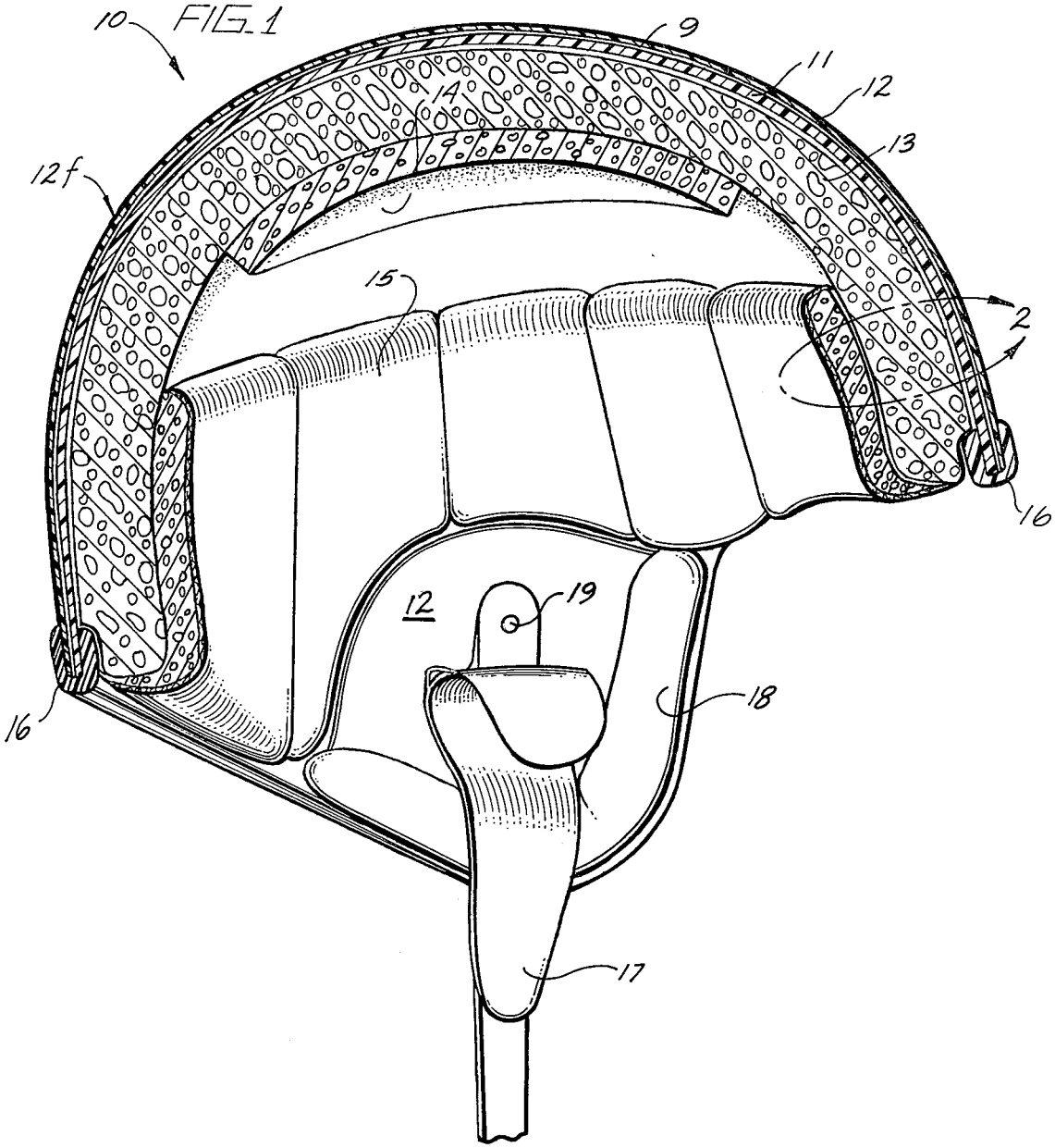
FIG. 1 is a cross-sectional view through a midsagittal plane of a safety helmet embodying the present invention.
Figure 2:
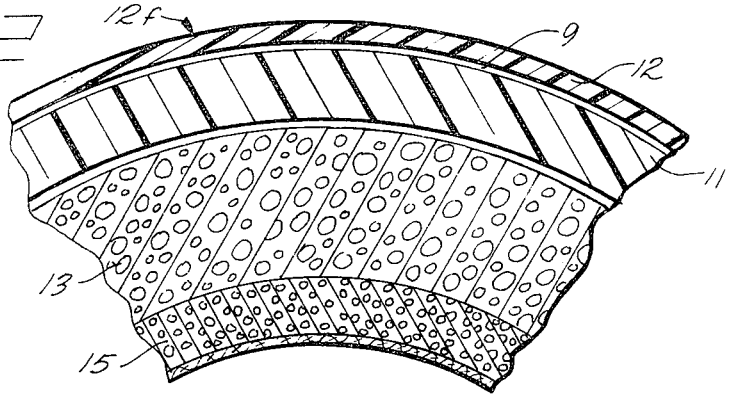
FIG. 2 is an enlarged, partial sectional view of the helmet structure illustrated in FIG. 1 taken through the area 2—2 of FIG. 1.

Now referring to the drawings, the improved safety helmet of the present invention will be examined in detail. With reference to FIGS. 1 and 2 in particular, it will be noted that the safety helmet 10 of the present invention is constructed of two dissimilar plastic materials formed into helmet shells to be worn on the head of a user. The primary shell 11 which may be constructed of an injection molded polycarbonate material is shaped to be worn on the head of a user so as to rest over and cover the entire upper and back portion of the head of a user. Along with the primary shell 11, a secondary shell 12 is provided and arranged on the outside surface of and in a closely spaced relationship with the primary polycarbonate shell 11. The secondary or outer shell may be constructed of a reinforced plastic material such as fiberglass reinforced resin by any of the various methods of manufacture known to the prior art. The outer shell 12 contains the entire outer surface of the primary shell 11 but also extends around the ear areas of the head of a user in a conventional fashion. The shells 11 and 12 may be press fitted together so as to be spaced apart by an air gap, such as the air gap 9 so as to allow the shells 11 and 12 to slide upon one another upon impact. The outside surface of the outer shell 12 may be provided with a thin, protective coating of a paint for decorative purposes and/or spraying a film for having abrasion and chemical resistant properties. Films of urethane are commercially available, and are suitable for the latter purposes. As is known in the art, a "jell coat" will form on the outside surface of a fiberglass shell which has a tendency to break off upon impact and the provision of the urethane coating will also prevent this from occurring. This outer film is identified by the reference numeral 12*f*.

The energy or shock absorption system of the present invention may comprise a one-piece foamed energy or shock absorbing liner 13 having a friction seal with the entire inner surface of the inner or primary shell 11 so as to protect the user's head. The shock liner 13 may be of conventional construction and comprises physical properties having a 70–80 percent compression factor and be of the viscous damping type. Such liners may be molded by using a viscoelastic (elastomer) thermoset polymer with a blowing agent. A shock absorbing layer 13 constructed in this fashion has inherent recoverability and memory allowing it to be used for multiple impacts. If the layer 13 includes viscous damping properties, its recovery from impacts will be static in nature and it tends to be dynamically nonresilient.

A crown piece or fitting pad 14 constructed of a soft resilient material may be secured to the liner 13 so as to extend over the top or crown portion of the user's head to further absorb energy and closely fit the helmet 10 to the particular configuration of the user's head when worn. A fabric-covered fitting pad 15 is also arranged and adhesively secured to the liner 13 below the crown piece 14 so as to encircle the inside of the shell 11 around the outer periphery, as illustrated. The fitting pad 15 encircles the wearer's head around the side and back of the head for closely mating the head to the shell 11 by means of the resilient properties of such a fitting pad. The exposed ends of the shells 11 and 12 are enclosed by means of an edge beading 16 that may encircle the entire periphery of the shell edges as illustrated in FIG. 1. The edge beading 16 may be constructed of a fabric-covered, ductile metal. A chin strap 17 may be secured in a suitable fashion to the inside surface of the portion of the outer shell 12 extending adjacent the wearer's ears as shown. The strap 17 may be secured by means of a swivel fastener 19 for custom fitting the chin strap to the user. The chin strap may be secured to the wearer's head in a conventional fashion by the provision of conventional D rings (not shown) for the chin strap 17. Ear paddings 18 may also be provided for energy absorbing purposes and are secured to the dependent portion of the two shells 11 and 12 so as to closely fit to the head of the wearer.

Figure 4:
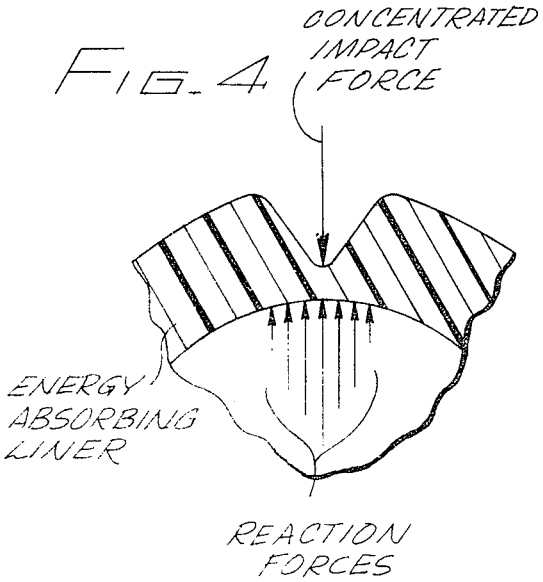
FIG. 4 is a diagrammatic illustration of the effect of a concentrated impact force on a shock absorbing liner per se.
Figure 5:
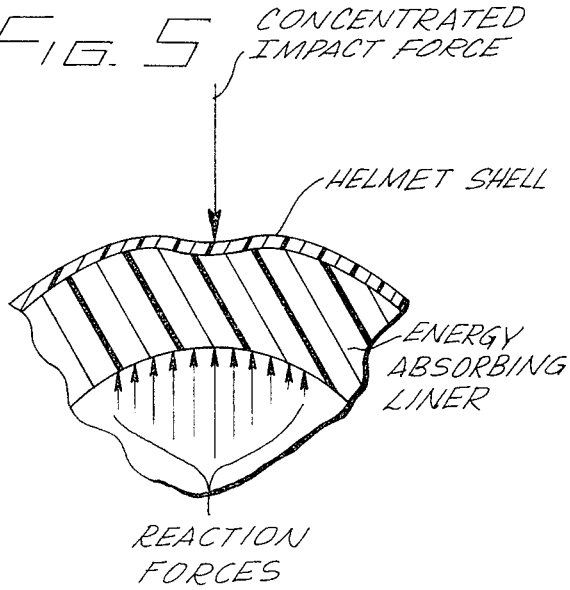
FIG. 5 is a diagrammatic illustration of the effect of a concentrated impact force on the combination of a helmet shell and an energy absorbing liner.

In accordance with the teachings of the present invention, the super-position of the two shells 11 and 12 in the manner described utilizes the advantages of the two different materials from which the shells 11 and 12 are constructed and to negate the disadvantages thereof. For this purpose, the interior or primary shell for receiving the impacts may be constructed of a polycarbonate material. The outer shell 12 may be constructed of a reinforced fiberglass resin having interlocked glass fibers contained with a thermal-setting matrix as is conventional. The polycarbonate shell 11 is constructed so as to have a thickness approximately three to four times the thickness of the outer shell 12. In one embodiment of the invention, the two shells 11 and 12 are pressed fit together in a closely spaced relationship with an air gap 9 therebetween. When the two shells are secured in this fashion, the relationship of the two shells 11 and 12 is such that it allows the shells to be movable relative to one another upon impact and slip over one another in a shearing action and thereby absorb some of the dynamic energy as a result of the flexure caused by impacts. The two shells are employed so as to distribute any impact loads over the shock liner or the energy absorbing liner 13 of the helmet 10. For this purpose the construction is such that the two shells 11 and 12 function together for distributing impact forces so as to reinforce each other as distinguished from acting independently and in a sequential relationship as in prior art helmets. The force distribution function of a single helmet shell with an energy absorbing liner and with the liner alone are best appreciated from examining FIGS. 4 and 5. The shell forces more of the energy absorbing liner to react to an impact thereby reducing the maximum stress to the wearer's head. With this type of construction, the fiberglass shell 12 will contain the polycarbonate shell 11 and in the event of catastrophic impact tending to sever the shell 11, it will be contained by the fiberglass shell 12. It has also been found that because of the relative thickness of the two shells 11 and 12 and the loading effects due to impact that the fiberglass shell 12 will not suffer any appreciable permanent damage. As a consequence, the helmet of the present invention can take repeated blows with no significant damage yet the energy upon impact is absorbed with the same efficiency as the prior art helmets that "self destruct" upon impact.

It should be noted that the shells 11 and 12 may be bonded together with an adhesive bonding agent or in any suitable fashion rather than provide the air gap 9 between the two. When the helmet 10 is constructed in this fashion the two shells 11 and 12 support each other by increasing the section modulii of the shell system over that which is obtainable by adding the individual modulii of two shells independently. This results in an increased load or force distribution capability for the two shell systems comprising the helmet 10.

Figure 6:
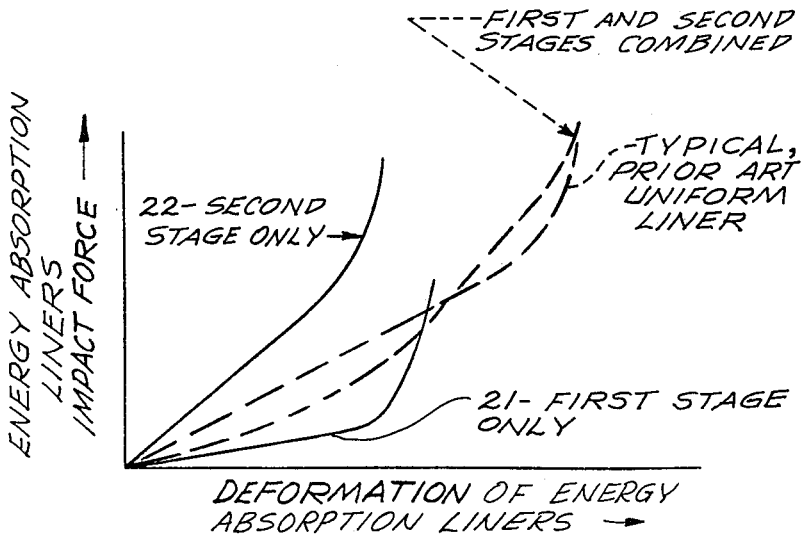
FIG. 6 is a graphical illustration of the impact forces vs. deformation for energy absorbing liners, taken alone or in combination.
Figure 3:
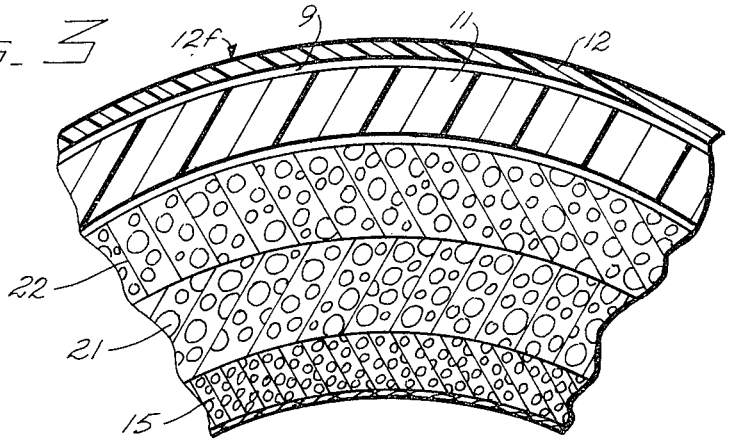
FIG. 3 is an enlarged, partial, sectional view similar to FIG. 2 but illustrating a modified helmet construction.

Now referring to FIG. 3, another embodiment of the helmet 10 will be described. This helmet structure is similar to the one illustrated in FIGS. 1 and 2 in respect to the shell system or structure — the difference lies with the energy absorbing liner system. The energy absorbing system illustrated in FIG. 3 is a dual stage type comprising the liners 21 and 22. The crushability, recoverability, viscous damping and hysteresis properties of the first liner 21 and the second liner 22 are different. The intended purpose of this is to provide a system that performs well during a variety of range of different impact loadings. For relatively low energy level impacts, the first stage liner 21 primarily acts in deformation to provide a viscous cushioning effect to protect the head. Because the inner liner 21 is selected to be softer than the outer line 22, it is forced to yield first and thus absorb energy that the outer liner 22 simply transmits. If the liner 21 were homogeneous as in the previous embodiment, it would not yield as much under low energy impact stress. The higher energy impacts will tend to "bottom out" the inner liner 21 so that the forces become high enough to deform the outer, second stage liner 22. The result of employing the two-stage liners 21 and 22 is graphically illustrated in FIG. 6 wherein the area under the curves represent energy absorbed. From reviewing this graphical representations in FIG. 6 it should be seen that the combination of the two energy absorbing layers results in providing a system that combines the advantages of the two selected layers. The forces for the low energy impacts are reduced while protection is also afforded to the higher level impact forces.

It should now be evident to those skilled in the helmetry art that the present invention has advanced the state of the art through the provision of a two-shell helmet system of the type described and claimed.

What is claimed is:

1. A safety helmet comprising a primary shell constructed of a preselected material having tough impact resistant properties and yet fractures upon substantial impact shaped to be worn on the head of a user, a relatively thin shell constructed of a different material from said preselected material arranged in a preselected relationship on the outside of the primary shell to contain the primary shell and having physically brittle properties to fracture upon minor impacts but to hold together in one piece to thereby contain the primary shell including upon substantial impacts to thereby complement the properties of the inner shell, whereby the materials coact to cancel out the negative features of each of the materials and making use of the advantages of both materials so as to provide a helmet that is virtually indestructible, and a shock absorbing liner secured to the inside of the primary shell.

2. A safety helmet as defined in claim 1 wherein the primary shell comprises a polycarbonate material and the outer shell is a fiberglass reinforced plastic, the two shells functioning together to distinguish any impact forces impinging on the reinforced plastic shell over the shock absorbing liner so as to reinforce one another.

3. A safety helmet as defined in claim 2 wherein the inner shell is on the order of three to four times the thickness of the outer shell.

4. A safety helmet as defined in claim 1 wherein the shock absorbing liner comprises a resilient shock absorbing liner.

5. A safety helmet as defined in claim 1 wherein the shock absorbing liner comprises a nonresilient shock absorbing liner.

6. A safety helmet as defined in claim 3 including a thin layer of abrasion and chemical resistant materials covering the outer surface of the outer shell.

7. A safety helmet as defined in claim 1 wherein the two shells are pressed fit closely together with an air gap therebetween to allow the shells to slip upon one another upon being impacted and thereby absorb some of the impact energy.

8. A safety helmet as defined in claim 1 wherein the two shells are adhesively secured together.

9. A safety helmet as defined in claim 1 wherein said shock absorbing liner comprises a first layer of energy absorbing material secured to the inner surface of the inner shell and a second layer secured to said first layer and being harder than the first layer so that low energy level impacts are absorbed by the first layer without deforming the second layer and so that high energy level impacts are absorbed by both layers.

10. A safety helmet comprising a primary shell constructed of a preselected material having tough impact resistant properties and yet fractures upon substantial impact shaped to be worn on the head of a user, a relatively thin shell constructed of a different material from said preselected material arranged in a preselected relationship with the primary shell and having physically brittle properties to fracture upon minor impacts but to hold together in one piece including upon substantial impact to thereby complement the properties of the primary shell, whereby the preselected materials coact to cancel out the negative features of each of the materials and make use of the advantages of both materials, a shock absorbing liner secured to the inside of the thus defined safety helmet, the shells functioning together to distribute any impact energy to the shock absorbing liner.

11. A safety helmet as defined in claim 10 wherein the primary shell comprises a polycarbonate material and the thin shell is a fiberglass reinforced plastic.

12. A safety helmet as defined in claim 10 wherein said shock absorbing liner comprises a first layer of energy absorbing material secured to the inner surface of the inner shell and a second layer secured to said first layer and being harder than the first layer so that low energy impacts are absorbed by the first layer without deforming the second layer and so that high energy level impacts are absorbed by both layers.

* * * * *